United States Patent [19]

Haslmayr

[11] 4,277,235

[45] Jul. 7, 1981

[54] PROCESS OF PRODUCING COOL AGGLOMERATED SOLIDS

[75] Inventor: Johann Haslmayr, Linz, Austria

[73] Assignee: Voest-Alpine Aktiengesellschaft, Linz, Austria

[21] Appl. No.: 111,213

[22] Filed: Jan. 11, 1980

[30] Foreign Application Priority Data

Jan. 30, 1979 [AT] Austria ..... 660/79

[51] Int. Cl.[3] ..... F26B 9/12; F27D 15/02

[52] U.S. Cl. ..... 432/18; 241/66; 241/178; 432/79; 432/80; 432/137

[58] Field of Search ..... 432/18, 79, 80, 137; 241/65, 66; 266/178, 179, 180

[56] References Cited

U.S. PATENT DOCUMENTS

| | | | |
|---|---|---|---|
| 3,155,378 | 11/1964 | Berg et al. | 432/77 |
| 3,824,068 | 7/1974 | Kobayashi | 432/80 |
| 3,909,189 | 9/1975 | Ban | 432/18 |

FOREIGN PATENT DOCUMENTS

| | | | |
|---|---|---|---|
| 1168713 | 4/1968 | United Kingdom | 432/137 |

*Primary Examiner*—John J. Camby
*Attorney, Agent, or Firm*—Kurt Kelman

[57] ABSTRACT

In a process and plant for producing cool sintered particulate agglomerated solids of ore, the solids are moved in a continuous stream through a heat-treating zone to form a layer of the agglomerated solids and hot particles thereof are obtained from the layer. The hot particles are moved in a continuous stream into a structurally separate cooler which is heat-insulated from the heat-treating zone and through the cooler in a cooling path. Cooling air is blown into the cooler to flow countercurrently to the continuous stream of hot particles in the cooling path to subject the hot particles to forced countercurrent cooling whereby the cooling air is heated by contact with the hot particles and the entire heated cooling air is delivered into the heat-treating zone.

26 Claims, 4 Drawing Figures

PROCESS OF PRODUCING COOL AGGLOMERATED SOLIDS

Figure 1:
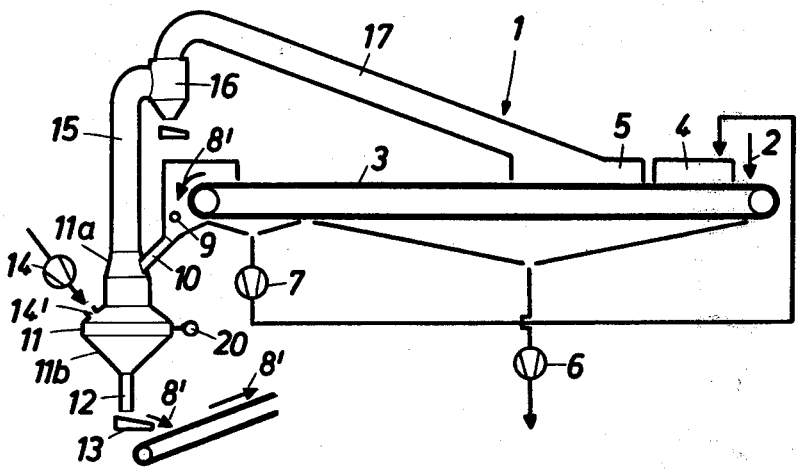

In a preferred embodiment, agglomerated solids discharged from the furnace are divided into hot particles and cool particles. Only the hot particles are cooled.

This invention relates to a process and equipment for cooling fired solids, such as sinter or pellets, which are discharged from a continuous furnace plant and are then crushed and subsequently cooled in a separate cooler by blown-in air.

The increasing demand for crude steel and crude iron must mainly be met by the purchase of dressed, fine-grained iron ores. Sintering and pelletizing processes are mainly used to agglomerate such fine-grained ores and concentrates. Sintering, particularly the sintering of fine-grained ores, as well as the firing of pellets, is almost exclusively carried out at the present time in continuous furnace plants which comprise a traveling grate because this is the only way in whch the required high throughput rate can be achieved. The solids move in the furnace plant through an igniting zone and a heat-treating zone and are then discharged from the furnace plant as hot sinter cake or as a layer of fired pellets and must subsequently be cooled in separate coolers, which are also continuous. For this purpose the solids are crushed and then contacted with cooling air. The coolers previously employed to cool such hot agglomerated solids consist of straight coolers, or annular pressure coolers, cellular coolers or stripping coolers and while they differ in design, they are used to carry out the same process, in which the hot solids are spread over a large surface to form a thin bed and are then cooled by a transverse current of air. This practice requires cooling air at a high rate so that the cooling air is heated to a temperature of only 200° C. As a result, it is not economical to recycle the heat recovered by cooling for use in the heat treatment of the solids in the furnace plant and the exhaust air is discharged into the atmosphere without further utilization in most cases. Another disadvantage of that cooling by a transverse current resides in the fact that the solids must be sieved before entering the cooler in order to remove the fines from the hot solids so that the flow of the cooling air through the agglomerated solids will not be obstructed.

It has already been attempted to utilize at least part of the heat recovered by cooling for the firing process. For this purpose it has been proposed to conduct the heated cooling air in two streams, one of which has a temperature of about 340° C. and is used in the firing process whereas the heat content of the remaining air, which is at a lower temperature, is lost.

It has also been proposed to fire pellets in a combined plant, which comprises a travelling grate plant for a preliminary firing of the pellets and a succeeding shaft furnace, in which the firing of the pellets is completed and the fired pellets are also cooled. Air that has been used for cooling in the cooling zone of the shaft furnace flows directly into the firing zone of the shaft furnace. In such an arrangement, the shaft furnace requires a considerable structural expenditure and has only a low throughput capacity so that a continuous conveyor installation must be succeeded by at least two and preferably three to six shaft furnaces.

In the clinker industry, a strict counter-current cooling process is known, which is carried out in a shaft cooler which directly succeeds a rotary kiln. Being provided with a roller grate, that shaft cooler cannot be used for treating sinter or pellets. If such a cooler were designed for a higher throughput, such as is required, in sintering plants, the roller grate would be subjected to an intolerably high wear. Besides, the cooling air is circulated rather than re-used in a firing process.

It is an object of the invention to provide a cooling process which is of the kind described first hereinbefore and in which virtually all heat recovered by cooling can be recycled to the firing process in an economical manner and without involving a high expenditure. Another object is to provide simple, effective equipment for carrying out said process.

In conjunction with the processing of a layer of agglomerated solids which has a hot lower portion and a cool upper portion, it is another object of the invention to obtain cool particulate agglomerated solids from said layer in a process in which only part of said solids are subjected to cooling and, if such enforced cooling is effected with the aid of a cooling gas, the gas is heated by the forced cooling to a high temperature so that its heat content can be economically utilized.

The first object stated hereinbefore is accomplished according to the invention in that the cooling air is countercurrently forced through the solids moving thrugh the cooler and the entire heated cooling air is delivered to the heat-treating zone in the furnace plant. In countercurrent cooling, cooling air is required at a lower rate than in cross-current cooling and the cooling air flowing through the solids to be cooled is heated almost to the temperature at which the solids enter the cooler, i.e., to a temperature of about 500° to 600° C. Cooling air having such a high temperature can be economically and completely utilized so that almost all heat recovered by cooling can be recycled to the firing process. This results in a saving of additional fuel required in the heat-treating zone of the furnace plant so that the economy of the overall plant is improved and a lower expenditure is sufficient to prevent environmental pollution, as most pollutants come from the fuel. Because the entire heated cooling air is delivered to the furnace plant, there is no need for a collection of dust from such air, as would be required if the heated cooling air were discharged into the atmosphere from the cooler. If the velocity of flow of the countercurrent cooling air is properly controlled, it will be possible to use that air at the same time for an air separation by which the fines can be removed from the hot solids before they are cooled. In that case it is no longer necessary to sieve the fines from the hot solids after they have been crushed and before they enter the cooler.

According to a particularly desirable embodiment of the process according to the invention, the layer of fired solids discharged from the furnace plant is divided into hot particles from the lower portion of the layer and into cool particles from the upper portion of the layer and only the hot particles are delivered to the cooler. Measurements have shown that the layer of fired solids discharged from the furnace has in its lower one-third a temperature of about 1100° C. and its upper portion amounting to about two-thirds of the height of the bed is almost at room temperature, and that the temperature does not change gradually but in a narrow interface. For this reason the layer of solids can be divided into hot and cool particles and it is sufficient to forward only the hot particles at about 900° C. to the cooler whereas the cold particles at about 30° C. can be directly subjected to cold sieving. As a result, the solids which enter the cooler are at more uniform and higher temperature so that the cooling air is also heated to a higher temperature and can be utilized more economically. Besides, the quantity of solids to be cooled per unit of time is decreased.

Because the solids are air-separated as they are cooled, the air stream leaving the cooler is desirably passed in accordance with the invention through a solids collector before entering the heat-treating zone. That solids collector serves to collect the hot fines which have been entrained by the cooling air flowing through the solids to be cooled and which are to be recirculated.

The process according to the invention can be carried out in a simple manner so as to meet all requirements in equipment which comprises an upright shaft cooler and which is characterized according to a further feature of the invention in that the shaft cooler accommodates a horizontal annular deck, which is known per se and oscillates in its plane and is associated with a pyramid- or cone-shaped chute, which is coaxial with the shaft cooler and spaced over the oscillating deck and tapers to an upper end disposed under the outlet of a feed duct, which is preceded by a crusher arranged to receive solids discharged from the furnace plant, the inlet opening for the cooling air is disposed adjacent to the oscillating deck, and the cooler has a tapered upper portion that is connected by an air duct to the heat-treating zone of the furnace plant. As a result of the cooperation of the chute and the oscillating deck, the solids which continuously enter the cooler through the feed shaft are spread to form an annular pile and are continuously discharged from said deck. The rising cooling air contacts the solids over a large area and can easily flow through the pile of solids. This results in a highly uniform cooling of the solids because they are discharged from the outside periphery of the oscillating deck at a higher velocity than at the inside periphery and because the pile formed by the solids is conical so that the mass flow density of the cooling air is higher near the wall of the shaft cooler, where the solids move at a higher velocity, than at the center of the shaft cooler. The oscillating deck is driven to reciprocate or to eccentrically rotate in its plane. It does not involve a high structural expenditure and is highly resistant to wear. The solids can be spread on the oscillating deck on a very large area so that a high throughput rate can be achieved even when the cooler has a low overall height.

It will also be desirable to provide the shaft cooler in accordance with the invention on its inside peripheral surface with annular guide plates, which together with the chute define a guide passage for directing the solids to the oscillating deck. This arrangement ensures an undisturbed flow of the material and further ensures that all of the cooling air blown into the region between the hot solids and the previously cooled solids flows through the moving solids to produce the highest possible cooling action.

The cooling may be accelerated further in that the chute is formed in accordance with the invention with air passages through which cooling air can flow to contact the solids as they slip down the chute.

The solids entering the cooler are subjected to air separation by the escaping cooling air at the upper surface of the pile of solids so that hot fines are entrained by the stream of heated cooling air. For this reason, the duct for conducting air from the cooler to the heat-treating zone suitably incorporates a solids collector for removing said hot fines from the heated cooling air.

According to a preferred further feature of the invention, the cooler is preceded by dividing means for dividing the fired solids into hot and cool particles. Said dividing means comprise a delivery passage for delivering the hot particles via the feed duct to the cooler and another delivery passage for delivering the cool particles, e.g., to cold sieving means. As the temperatures in the layer of solids leaving the firing furnace differ greatly from bottom to top, such dividing means may be used to remove the cool particles, which need not be supplied to the cooler and may be directly cold-sieved. The remaining hot particles are supplied to the feed duct leading to the cooler and are cooled in the cooler. As a result, hotter air is supplied from the cooler to the heat-treating zone and it is sufficient to pass solids at a lower rate through the cooler.

The division of the layer of solids into hot particles and cool particles can be accomplished in a simple manner by a splitting device which comprises a wedge-shaped hammer, which may be pneumatically operated and blows upwardly, and a guiding grate, by which fired solids discharged from the furnace plant are delivered to a region in which they are subjected to the action of the hammer. The hot solids discharged from the furnace plant are engaged by the guide grate and are deflected by it to be presented to the hammer from above so that the hammer when operated disintegrates the agglomerated solids into hot and cool particles. Because the hammer is wedge-shaped, the hot particles of agglomerated solids can slide on one side face of the hammer and the cool particles on the opposite side face.

The guide grate is preferably provided at its delivery end with end sections that are adjustable transversely to the center plane of the hammer. By such an adjustment of the grate relative to the plane in which the hammer is acting, the thickness ratio of the hot and cool particles can be varied and the temperature and rate of the solids delivered to the cooler and of those which are directly cold-sieved can be influenced.

Figure 4:
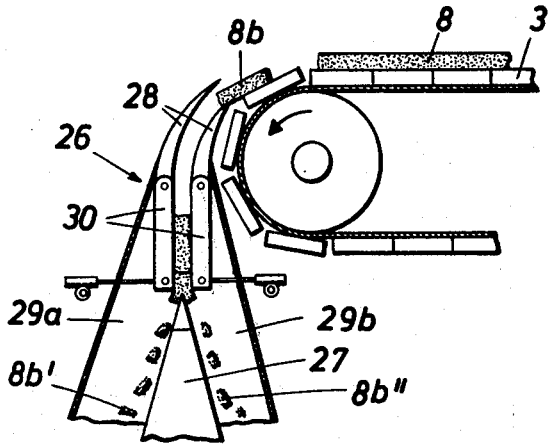
Figure 2:
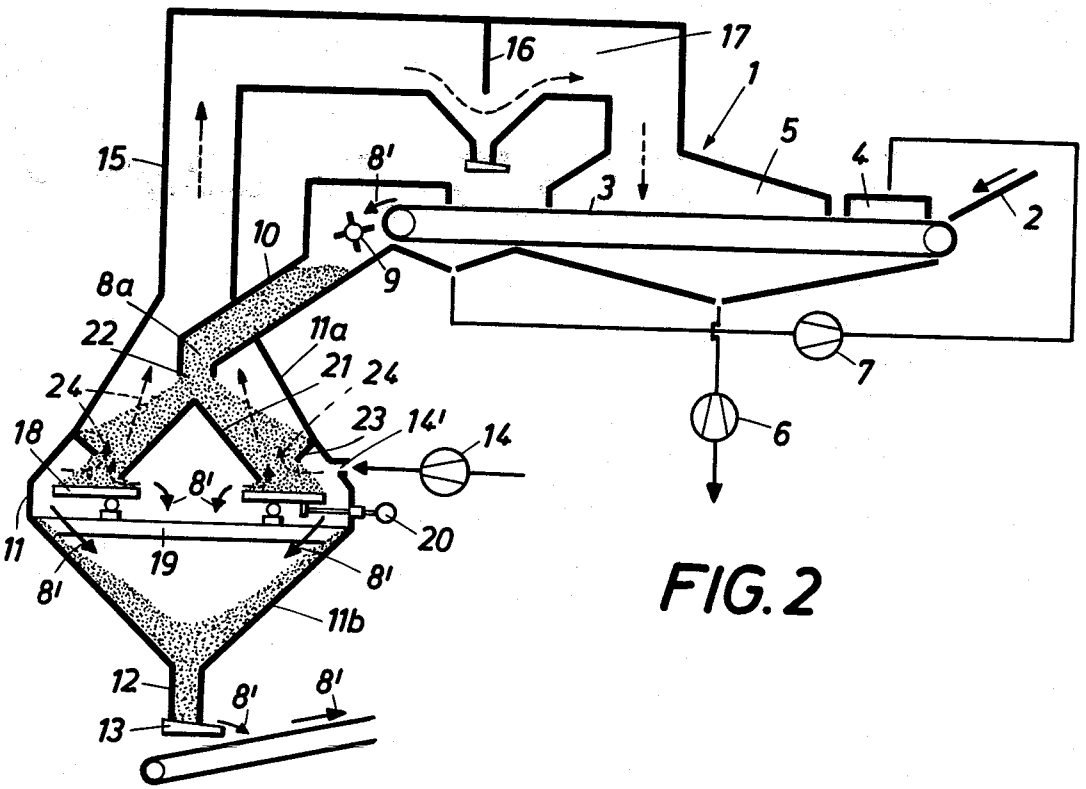
Figure 3:
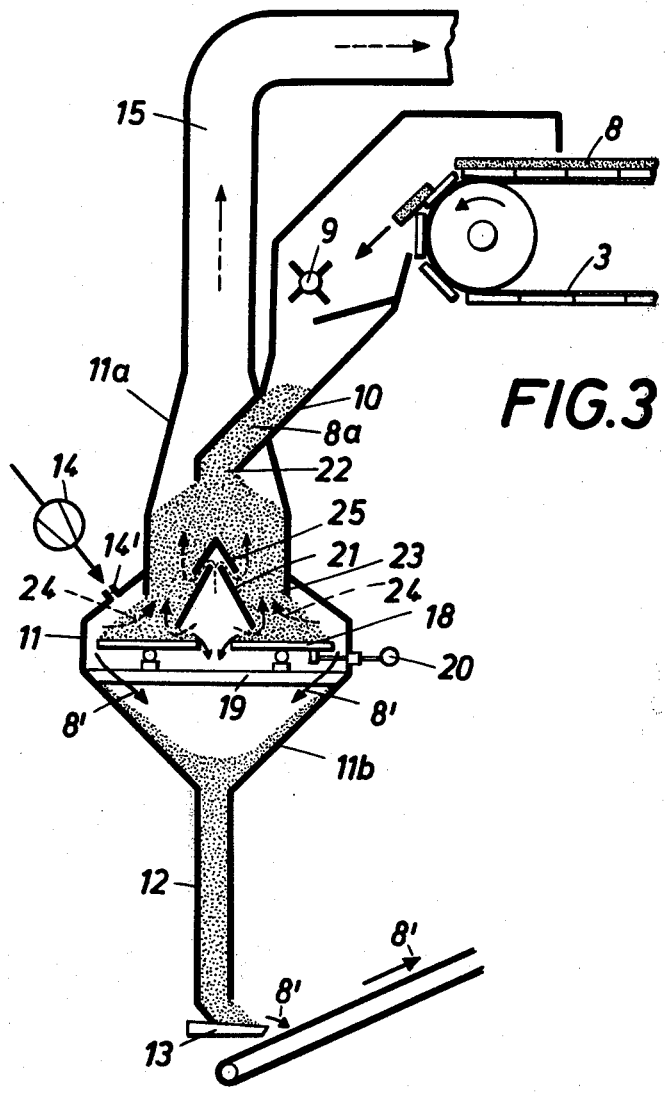

The subject matter according to the invention is strictly diagrammatically illustrated on the accompanying drawings, in which FIG. 1 shows a complete sintering plant, FIGS. 2 and 3 show two illustrative embodiments of a cooler according to the invention and FIG. 4 shows a splitting device according to the invention.

In a continuous furnace plant 1 for sintering fine-grained ore, the solids to be sintered are delivered by a feeder 2 to a traveling grate 3 and are moved by the latter through an igniting zone 4 and a heat-treating zone 5. By an exhaust blower 6, the cooler exhaust gases formed during the sintering process are discharged into the atmosphere. The hotter exhaust gases are recycled to the igniting zone 4 by a blower 7. The completely sintered solids form a sinter cake 8, which is discharged from the furnace plant and falls in the form of large pieces from the traveling grate 3 and enters a toothed-roll crusher 9 and is crushed therein to small pieces. The crushed sinter cake is fed through a feed duct 10 into a shaft cooler 11, from which the cooled solids are discharged via a discharge duct 12 and a discharge trough 13, as is indicated by arrows 8'. The sintered solids are cooled by cooling air, which is blown by a blower 14 into the cooler 11 and in the latter flows countercurrently through the charge. The heated cooling air is withdrawn upwardly through an air duct 15 to a solids collector 16, in which hot fines are collected and from which all of the heated cooling air is subsequently delivered in duct 17 to the heat-treating zone so that virtually all heat recovered by the cooling process can be re-used in the sintering process.

The shaft cooler 11 may be circular or polygonal in cross-section and has an upwardly tapering top portion 11*a*, to which the air duct 15 is connected, and a funnel-shaped lower portion 11*b*, which merges into the discharge duct 12. The shaft cooler 11 accommodates a horizontal oscillating annular deck 18, which is slidable on a grate 19 and to which an eccentric rotation or reciprocating motion in the plane of the deck can be imparted by drive means 20. A cone- or pyramid-shaped chute 21 is fixedly mounted on the grate 19 and is spaced above and cooperates with the oscillating deck 18. The chute 21 tapers upwardly to a pointed tip, which lies under the outlet 22 of the feed duct 10. As a result, the crushed sinter 8*a* to be cooled is delivered by the chute 21 to the oscillating deck 18 in a uniform distribution and owing to the motion of the oscillating deck is uniformly discharged therefrom on the outside periphery thereof and through the gap between the inside periphery of the oscillating deck and the chute. The cooler is provided on its inside peripheral surface with annular guide plates 23, which control the flow of solids and compel the cooling air to flow through the pile of moving solids. The cooling air is blown by the blower 14 through inlet openings 14' of the shaft cooler 11 into that region thereof which is near the oscillating deck 18 between the previously cooled solids and the still hot solids. The cooling air then flows countercurrently through the pile of solids to be cooled, as indicated by arrows 24. The feed duct 10 is so long that the sinter 8*a* therein acts as a seal through which cooling air can escape only at an extremely low rate. This will be true also for the discharge duct 12 if it is sufficiently long. Alternatively, if a small overall height is desired, a seal may be provided by a known lock chamber defined by two hinged valves.

To ensure a more rapid cooling, the chute 21 may be formed with air passages 25, as is indicated in FIG. 3.

FIG. 4 shows that the cooler 11 may be preceded by a splitting device 26 for dividing each piece of sintering cake 8 into hot particles and cool particles. Measurements have shown that that side of the sinter cake which lies on the traveling grate 3 is much hotter than the exposed upper surface of said cake. For this reason each piece of sinter cake can be split by the splitting device 26 into hot and cool particles and it will be sufficient to feed only the hot particles to the cooler 11 whereas the cool particles may be directly subjected to cold-sieving, for instance. The splitting device 26 comprises a pneumatically operated hammer 27, which cooperates with a guide grate 28, by which the pieces of sinter cake 8*b* falling from the travelling grate are engaged on both sides and guided into the region in which they are acted upon by the hammer 27. As a result, each piece of sinter cake is split into a cooler portion 8*b'* and a hotter portion 8*b''*. The cool particles 8*b'* are delivered via a passage 29*a*, e.g., to a cold-sieving plant. The hot particles 28*b* are delivered via a passage 29*b* and the feed duct 10 to the cooler 11. The ratio between the cool and hot particles 8*b'* and 8*b''* can be varied because the guide grate 28 is provided at its delivery end with adjustable end sections 30 so that the position in which the pieces of sinter cake 8*b* are presented to the hammer 27 can be adjusted relative to the plane of action of the hammer and the proportion and temperature of the particles 8*b''* delivered to the cooler can be controlled.

What is claimed is:

1. A process of producing cool sintered particulate agglomerated solids of ore, comprising the steps of (a) moving particulate solids of ore in a continuous stream through a heat-treating zone to form a layer of the agglomerated solids, (b) obtaining hot particles of the agglomerated solids of ore from the layer, (c) moving the hot particles in a continuous stream into a cooler which is structurally separate and substantially heat-insulated from the heat-treating zone, and through the cooler in a cooling path, (d) blowing cooling air into the cooler to flow countercurrently to the continuous stream of hot particles in the cooling path whereby the hot particles are subjected to forced countercurrent cooling to obtain the cool sintered particulate agglomerated solids of ore and the cooling air is heated by contact with the hot particles, and (e) delivering substantially the entire heated cooling air into the heat-treating zone.

2. The process of claim 1, wherein the agglomerated solids are formed into a sinter in the heat-treating zone.

3. The process of claim 1, wherein the agglomerated solids are formed into fired pellets in the heat-treating zone.

4. The process of claim 1, comprising the further step of removing hot fines entrained by the heated cooling air before it is delivered into the heat-treating zone.

5. The process of claim 1, comprising the further step of controlling the flow rate of the cooling air blown into the cooler so that the countercurrently flowing cooling air is heated substantially to the temperature of the hot particles wherewith it is in contact.

6. A process of producing cool sintered particulate agglomerated solids of ore, comprising the steps of (a) moving particulate solids of ore in a continuous stream through a heat-treating zone to form a layer of the agglomerated solids wherein a first portion of the layer is hotter than a second portion thereof, (b) dividing the layer portions along an interface, (c) obtaining hot particles of the agglomerated solids of ore from the divided first portion of the layer and a part of the cool sintered particulate agglomerated solids of ore from the divided second layer portion, and (d) moving only the hot particles of the agglomerated solids of ore from the divided first layer portion in a continuous stream through a path of forced cooling to obtain another part of the cool sintered particulate agglomerated solids.

7. The process of claim 6, wherein the agglomerated solids are formed into a sinter in the heat-treating zone.

8. The process of claim 6 or 7, wherein the hot particles are moved into a cooler which is structurally separate and substantially heat-insulated from the heat-treating zone, and through the cooler in the path of forced cooling, blowing cooling air into the cooler to flow counter-currently to the continuous stream of hot particles in the forced cooling path whereby the hot particles are subjected to forced countercurrent cooling and the cooling air is heated by contact with the hot particles, and delivering substantially the entire heated cooling air into the heat-treating zone.

9. A plant for producing cool sintered particulate agglomerated solids of ore, comprising (a) a furnace defining a heat-treating zone, (b) means for moving particulate solids of ore in a continuous stream through the heat-treating zone of the furnace to form a layer of the agglomerated solids, (c) means for obtaining hot particles of the agglomerated solids of ore from the layer, (d) a cooler which is structurally separate from the furnace and substantially heat-insulated from the heat-treating zone, (1) the cooler being arranged to receive the hot particles and to cause the hot particles to move therethrough in a continuous stream in a cooling path, (e) means for blowing cooling air into the cooler to flow countercurrently to the continuous stream of hot particles in the cooling path whereby the hot particles are subjected to forced countercurrent cooling to obtain the cool sintered particulate agglomerated solids of ore and the cooling air is heated by contact with the hot particles, and (f) duct means delivering substantially the entire heated cooling air into the heat treating zone in the furnace.

10. A plant as set forth in claim 9, in which a solids collector for collecting entrained solids from said heated cooling air is incorporated in said duct means.

11. A plant for producing cool sintered particulate agglomerated solids or ore, comprising (a) a furnace defining a heat-treating zone, (b) means for moving particulate solids of ore in a continuous stream through the heat-treating zone in the furnace to form a layer of the agglomerated solids wherein a first portion of the layer is hotter than a second portion thereof, (c) means for dividing the layer portions along an interface, the dividing means separating the layer into hot particles of the agglomerated solids from the divided first portion of the layer and a part of the cool sintered particulate agglomerated solids of ore from the divided second layer portion, and (d) a cooler arranged to receive a continuous stream of only the hot particles and to subject the hot particles to forced cooling to obtain another part of the cool sintered particulate agglomerated solids.

12. The plant of claim 11, wherein the cooler is structurally separate from the furnace and substantially heat-insulated from the heat-treating zone, and further comprising means for blowing cooling air into the cooler to flow countercurrently to the continuous stream of hot particles whereby the hot particles are subjected to force countercurrent cooling and the cooling air is heated by contact with the hot particles, and duct means delivering substantially the entire heated cooling air into the heat-treating zone in the furnace.

13. A plant for producing cool particulate agglomerated solids, comprising (a) a furnace defining a heat-treating zone, (b) means for moving solids in a continuous stream through the heat-treating zone to form a layer of agglomerated solids, (c) dividing means for obtaining hot particles from the layer, (d) an upright shaft cooler which is structurally separate from the furnace, the cooler having an upwardly tapering upper portion and an air inlet, (e) a feed duct arranged to receive the hot particles from the dividing means and to cause the hot particles to move in a continuous stream along a forced cooling path, (f) blowing means for blowing cooling air through the air inlet into the cooler to flow countercurrently along the cooling path to and in contact with the hot particles whereby the hot particles are subjected to forced cooling and the cooling air is heated, (g) a horizontal annular deck accommodated in the shaft cooler adjacent the air inlet in the cooling path, the annular deck being mounted to be horizontally movable, (h) drive means operable to oscillate the deck in its plane, (i) a chute accommodated in the shaft cooler and coaxial therewith, the chute being spaced over the deck in the cooling path and tapering upwardly to an apex, (1) the feed duct having an open lower end disposed over the apex, and (j) duct means connected to the upwardly tapering upper portion of the shaft cooler for supplying all of the heated cooling air from the cooler to the heat-treating zone.

14. A plant as set forth in claim 13, in which said chute is pyramid-shaped.

15. A plant as set forth in claim 13, in which said chute is cone-shaped.

16. A plant as set forth in claim 13, in which said dividing means comprise a crusher.

17. A plant as set forth in claim 13, in which peripherally extending annular guide plates are mounted on the inside peripheral surface of said shaft cooler and spaced around said chute and define said enforced cooling path.

18. A plant as set forth in claim 14, in which said chute is open-bottomed and is formed with lateral air passages.

19. A plant for producing cool particulate agglomerated solids, comprising (a) a furnace defining a heat-treating zone, (b) means for moving solids in a continuous stream through the heat-treating zone to form a layer of agglomerated solids, which layer has a hot thickness portion and a cool thickness portion, (c) means for dividing the layer to obtain hot particles from the hot portion and cool particles from the cool portion, and for separating the hot particles from the cool particles, the dividing means including (1) a wedge-shaped hammer having a transverse striking edge and longitudinally reciprocable to move the striking edge in a predetermined plane, (2) means for obtaining pieces of agglomerated solids from the hot and cool portions of the layer, and (3) guide means for receiving the pieces and for presenting them to the striking edge to be struck thereby with such an orientation that the hot particles are on one predetermined side and the cool particles are on the other side of the plane, and (d) a cooler arranged to receive only the hot particles from the dividing means and operable to subject the hot particles to forced cooling.

20. A plant as set forth in claim 19, in which said hammer is vertically reciprocable.

21. A plant as set forth in claim 20, in which said means for moving said solids in said furnace are arranged to discharge said layer with a horizontal orientation and in a horizontal direction out of said furnace, said dividing means are arranged to divide said layer into pieces of agglomerated solids, and said guide means are arranged to deflect each of said pieces and to present it to said hammer in a vertical orientation.

22. A plant as set forth in claim 19, in which said hammer is pneumatically operable.

23. A plant as set forth in claim 19, in which said guide means comprise a guide grate.

24. A plant as set forth in claim 19, in which said guide grate has end sections which are adjustable relative to said plane.

25. A plant for cooling hot solid particles, comprising an upright shaft cooler having an upwardly tapering upper portion and an air inlet, an upright shaft cooler which defines an enforced cooling path and has an upwardly tapering upper portion and an air inlet, a horizontal annular deck which is accommodated in said shaft cooler adjacent to said air inlet and defines said enforced cooling path and is mounted to be horizontally movable, drive means operable to oscillate said deck in its plane, a chute accommodated in said shaft cooler and coaxial thereto and spaced over said deck and tapers upwardly to an apex and defines said enforced cooling path, a feed duct having an open lower end disposed over said apex and adapted to deliver said hot particles to said chute and to cause said hot particles to move along said enforced cooling path, and blowing means for blowing cooling air through said air inlet to flow countercurrently to and in contact with said hot particles along said enforced cooling path, whereby said hot particles are subjected to enforced cooling and said cooling air is heated.

26. Dividing means for dividing pieces of agglomerated solids having first and second thickness portions which have different properties, comprising a wedge-shaped hammer having a transverse striking edge and longitudinally reciprocable to move said striking edge in a predetermined plane, and guide means for presenting said pieces and for presenting them to said striking edges to be struck thereby with such an orientation that said first thickness portion is on one predetermined side and said second thickness portion is on the other side of said plane.

* * * * *